US005870963A

United States Patent [19]

Alan

[11] Patent Number: 5,870,963

[45] Date of Patent: Feb. 16, 1999

[54] MOORING LINE RETRIEVAL SYSTEM

[76] Inventor: Brad Alan, 1205 Orchard Ct., Columbus, Mich. 48063

[21] Appl. No.: 58,688

[22] Filed: Apr. 10, 1998

[51] Int. Cl.[6] ..... B63B 21/00

[52] U.S. Cl. ..... 114/230; 114/221 R

[58] Field of Search ..... 114/343, 221 R, 114/364, 218, 230, 293

[56] References Cited

U.S. PATENT DOCUMENTS

| | | | |
|---|---|---|---|
| 2,832,116 | 4/1958 | Clevett, Jr. et al. . | |
| 3,012,736 | 12/1961 | Brust . | |
| 3,129,688 | 4/1964 | Buchholz | 114/230 |
| 3,540,083 | 11/1970 | O'Conner | 114/230 |
| 3,841,685 | 10/1974 | Kolodziej . | |
| 3,897,745 | 8/1975 | Hutchings . | |
| 4,079,690 | 3/1978 | Paul . | |
| 4,109,603 | 8/1978 | Guthmann . | |
| 4,114,553 | 9/1978 | Zidek . | |
| 4,200,053 | 4/1980 | Vall . | |
| 4,299,183 | 11/1981 | Prock . | |
| 4,519,643 | 5/1985 | Harris . | |
| 4,531,470 | 7/1985 | Paul . | |
| 4,597,354 | 7/1986 | Gelula . | |
| 4,648,159 | 3/1987 | Dougherty . | |
| 4,697,537 | 10/1987 | Smith . | |
| 4,733,625 | 3/1988 | Allen . | |
| 4,771,719 | 9/1988 | Chlebowski . | |
| 4,846,090 | 7/1989 | Palmquist . | |
| 4,912,816 | 4/1990 | Brandt . | |
| 4,913,078 | 4/1990 | Haverly . | |
| 4,998,497 | 3/1991 | Nelson et al. . | |
| 5,050,813 | 9/1991 | Ishikawa et al. . | |
| 5,116,260 | 5/1992 | Upchurch . | |
| 5,123,374 | 6/1992 | McMillan . | |
| 5,365,872 | 11/1994 | Obrinski . | |
| 5,598,805 | 2/1997 | Obrinski | 114/230 |

*Primary Examiner*—Stephen Avila
*Attorney, Agent, or Firm*—Peter D. Keefe

[57] ABSTRACT

A retrieval system for a mooring line when a skipper is ready to shove-off composed of at least one mooring line receptacle for a mooring line, wherein the mooring line has a release actuator at its distal end. A connector is slidably captured on the mooring line for being engaged by the release actuator. A retrieval cable for actuating the release actuator and for retracting the mooring line into its mooring line receptacle is connected to a slide slidably interfaced with the mooring line receptacle for being pulled along the mooring line receptacle so as to retract the mooring line into the mooring line receptacle. In operation, the mooring line is pulled from its mooring line receptacle via the connector, looped around a cleat, piling, etc. of a dock and then the release actuator is seated in the socket to thereby secure the mooring line as a closed loop therearound. When the skipper is ready to shove-off, the slide is pulled along the mooring line receptacle in a direction away from the eyelet. This pulling force causes the retrieval cable to trip the release actuator so as to allow the release actuator to separate from the socket. Continued pulling on the slide, results in the slide moving along the mooring line receptacle, whereupon the retrieval cable to enter into the mooring line receptacle followed by the mooring line.

19 Claims, 4 Drawing Sheets

MOORING LINE RETRIEVAL SYSTEM

BACKGROUND OF THE INVENTION

1. Field of the Invention

The present invention relates to mooring lines for nautical vessels, and more particularly to a retrieval system for mooring lines, wherein the mooring line is stored as it is retrieved.

2. Description of the Prior Art

Watercraft, such as motor and sail boats, utilize fore and aft mooring lines at each of the port and starboard sides thereof to secure the watercraft to a dock facility. In this regard, the dock facility generally has a number of cleats or other structures, such as pilings, to which mooring lines of the watercraft may be connected.

Typically, a watercraft will have a mooring line for being connected with cleats on the watercraft in anticipation of future and present docking needs. Cleats are usually provided fore and aft at each of the starboard and port sides of the watercraft, whereupon four mooring lines would be needed to be connected to these four cleats.

Problematically, when a skipper leaves dock, the mooring lines may be loosely placed on the boat deck, whereafter they may slide off and then dangle into the water. Dangling mooring lines are, of course, unsightly and they can add drag and pose other problems to operation of the watercraft. On the other hand, if the mooring lines are secured to some component of the boat deck to prevent potential dangling, then when the mooring lines need to be made ready for docking considerable time and effort must be expended to free the lines. This lost time could be critical if a skipper is in need of a fast securement to the dock in the event of an untoward docking situation, such as when other boats may limit free navigation or high seas or winds make docking particularly tricky.

The inventor hereof has developed a mooring line receptacle apparatus, as described in U.S. Pat. No. 5,598,805, issued on Feb. 4, 1997, hereby incorporated by reference; patent application Ser. No. 08/791,973, filed on Jan. 31, 1997, hereby incorporated by reference; and patent application Ser. No. 09/026,596, filed on Feb. 20, 1998, hereby incorporated by reference. In these disclosures of the inventor hereof, the inventor hereof details an effective, simple and easy to use way to hold mooring lines in a stored state with respect to the watercraft, yet the mooring lines are instantly available when docking is imminent.

A first mooring line receptacle apparatus includes, according to the aformentioned incorporated by reference disclosures, an elongated mooring line receptacle, in the form of a single piece or a plurality of discrete segments which may be mutually touching or mutually spaced apart, for each mooring line, wherein each mooring line receptacle, wherein each mooring line receptacle is connected with watercraft at the gunwale thereof; and further includes a mooring line having an abutment member connected to the distal end thereof. The mooring line receptacle has an interior hollow formed by a sidewall composed of a durable, resilient material having a longitudinal slot therein. The sidewall opposite the slot is attached to the hull of a selected watercraft via threaded fasteners. One mooring line receptacle is located at the port bow, another at the starboard bow, another at the port stern and another at the starboard stern. Preferably, each of the sets of port and starboard mooring line receptacles end near each other at a location on the gunwale where the skipper and crew/passengers enter and leave the watercraft, generally amidship of the watercraft. The mooring line is conventional nylon or other rope material used for nautical moorage. The slot has a width smaller than the cross-section of the mooring line, such that the mooring line can be forced progressively through the slot into the interior hollow of the mooring line receptacle, and thereupon be trapped therein such that the mooring line cannot fall out of the hollow through the slot. The abutment member then abuts the end of the mooring line receptacle to thereby prevent the distal end of the mooring line from sliding into the interior hollow.

In operation, each of the port bow, port stern, starboard bow and starboard stern mooring lines have the proximate ends thereof looped over or otherwise connected with their respective cleat on the watercraft. Each mooring line is then respectively pressed into its mooring line receptacle progressively along the slot thereof and past any spacing between the receptacle segments. When docking, the skipper or a crew member grabs a mooring line, via the abutment member thereof, on the side of the watercraft facing a dock facility, and then pulls upon the mooring line to thereby free it from its mooring line receptacle via exiting progressively along the slot thereof. The person then secures that mooring line in a conventional way to the dock facility, such as for example at a dock cleat or dock piling. Other of the mooring lines are then grabbed at their respective abutment member, freed and tied as was done with the first mooring line. When it is time to shove-off, the mooring lines tied to the dock facility are released therefrom and then slipped progressively through the slot of their respective mooring line receptacles for later use when docking is to again take place.

A second mooring line receptacle apparatus according to the aformentioned incorporated by reference disclosures is generally similar to the aforementioned first mooring line receptacle apparatus, inclusive of being in the form of a single piece or a plurality of discrete receptacle segments which may be mutually touching or mutually spaced apart, where now the mooring line freely passes through the slot and is not forced therethrough. The mooring line simply lays in the interior hollow of the mooring line receptacle and is held substantially taught by an abutment member which is snappably engageable into the slot. Preferably, the abutment member is adjustably positionable on the mooring line to thereby be positioned to abut the far end of the mooring line receptacle when the mooring line is resident therein. A guide member at the near end of the mooring line receptacle aids to guide the mooring line into the slot when the mooring line is being stored thereinside.

While the above described mooring line receptacle apparatus operates very well to easily and neatly store and release mooring lines elongatedly with respect to a vessel, there remains needed an easy way to effect retraction of the mooring lines into the mooring line receptacles when a skipper is ready to shove-off. Accordingly, what is needed in the art is some effective, simple and easy to use way to retract a mooring line into its mooring line receptacle.

SUMMARY OF THE INVENTION

The present invention provides an effective, simple and easy to use way to retrieve the mooring line and retract it into its mooring line when a skipper is ready to shove-off.

The mooring line retrieval system according to the present invention is composed of at least one mooring line receptacle for a mooring line, wherein the mooring line has a release actuator at its distal end, a connector slidably captured on the mooring line for being engaged by the release actuator, a retrieval cable for actuating the release actuator and for retracting the mooring line into its mooring line receptacle, and a slide slidably interfaced with the mooring line receptacle and connected to the retrieval cable for being pulled along the mooring line receptacle so as to retract the mooring line into the mooring line receptacle.

The mooring line receptacle is connected elongatedly to the vessel at any convenient location, be that the hull or the deck, for example. The mooring line receptacle has an exposed slot running its length. The slide is notched so as to be interfaced with the slot, whereby it is slidable therealong but cannot be dislodged therefrom. The near end of the mooring line receptacle has an eyelet through which the retrieval cable (which is connected to the slide) emerges from the mooring line receptacle. The mooring line is connected at its near end to a cleat of the vessel. The distal end of the mooring line is provided with the aforementioned release actuator. The release actuator includes a pivotable tab which is pivotal responsive to a tugging force applied to the retrieval cable. The connector has a bore through which the mooring line slidably passes. The connector further has a socket into which the release actuator seats to thereby form a closed loop of the mooring line between the seat and the bore of the connector.

In operation, the mooring line is pulled from its mooring line receptacle via the connector, looped around a cleat, piling, etc. of a dock and then the release actuator is seated in the socket to thereby secure the mooring line. When the skipper is ready to shove-off, the slide is pulled along the mooring line receptacle in a direction away from the eyelet. This pulling force causes the retrieval cable to trip the release actuator so as to retract the tab and allow the release actuator to separate from the socket. Continued pulling on the slide results in the slide moving along the mooring line receptacle and the retrieval cable to enter into the mooring line receptacle, whereupon the mooring line will follow thereinto therebehind.

Accordingly, it is an object of the present invention to provide a mooring line retrieval system for a watercraft which provides for easy, simple, outstretched storage of mooring lines when not used and retractable retrieval of the mooring line when use has finished.

These, and additional objects, advantages, features and benefits of the present invention will become apparent from the following specification.

DETAILED DESCRIPTION OF THE PREFERRED EMBODIMENT

Figure 1:
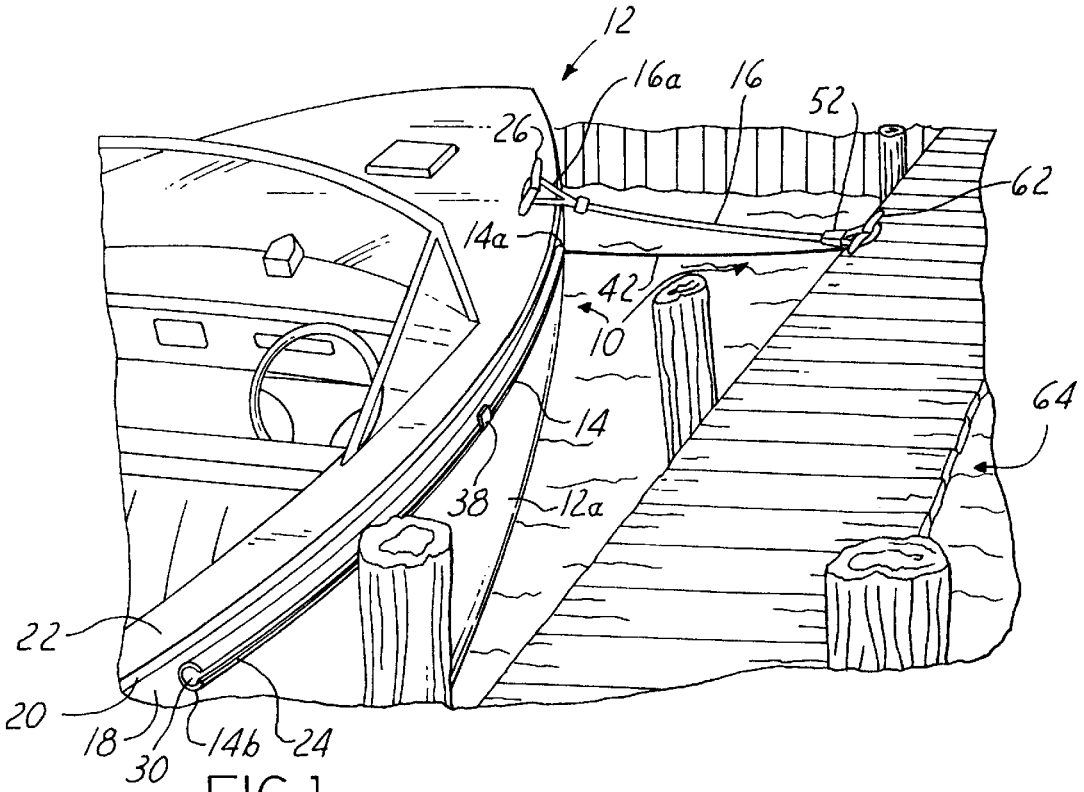
FIG. 1 is a perspective view of a watercraft equipped with a mooring line retrieval system according to the present invention.

Referring now to the Drawing, FIG. 1 generally depicts the mooring line retrieval apparatus 10, wherein at least one mooring line receptacle 14 is secured to the hull 12*a* of the watercraft 12 at a desired location thereof which may be for example along the hull at the gunwale 18 or along the deck 22 thereof preferably adjacent the bumper 20 (if present) so that it is out of the way yet easily reached from the deck. Preferably there are two mooring line receptacles 14 located on the port and starboard sides of the watercraft 12, but the actual number may be one or four or another number. Each mooring line receptacle 14 has an interior holow 30 which communicates with a slot 24 running the length thereof.

The proximate end 16*a* of a mooring line 16 of a respective mooring line receptacle 14 is connected conventionally (by a loop or a knot) with a respective cleat 26, as shown in FIGS. 1 and 3 through 5. The mooring line receptacle 14 has an near end 14*a*, and an opposite far end 14*b*, wherein the near end is located adjacent a respective cleat 26. The mooring line receptacles 14 are elongated so that the spacing between the near and far ends 14*a*, 14*b* run along much of the port and/or starboard sides of the watercraft (see FIGS. 3 through 5)

Each mooring line receptacle 14 is composed of a durable material, preferably plastic, and is formed of an elongated sidewall 25. The sidewall 25 forms the interior hollow 30 and the slot 24 provided in the sidewall communicates with the interior hollow and runs the length thereof. A preferred cross-sectional shape of the sidewall 25 is cylindrical; if, however, added stability is desired, a flattened face may be provided at the exterior of the sidewall where it interfaces with the hull.

Figure 8:
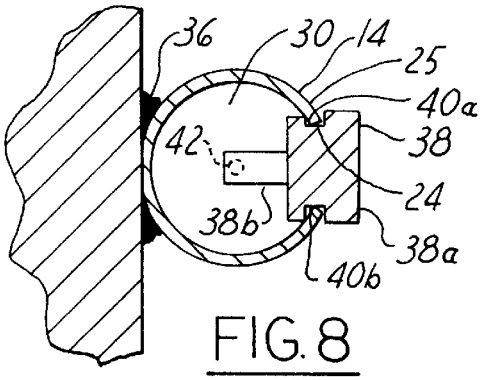
FIG. 8 is a partly sectional view seen along line 8—8 of FIG. 7.
Figure 9:
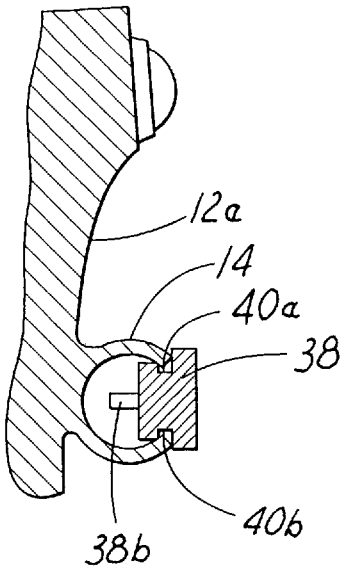
FIGS. 9 and 10 are partly sectional views similar to FIG. 8, wherein now the mooring line receptacle is integrally formed with the watercraft hull.
Figure 10:
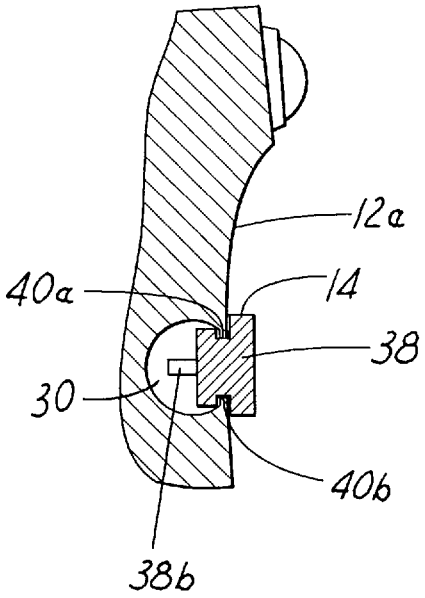

As depicted by FIG. 8, the sidewall 25 opposite the slot 24 is attached to a selected location of a watercraft 12 preferably via a two-sided adhesive foam 36; however it could be attached otherwise, such as by a glue or threaded fasteners. Alternatively, the mooring line receptacles 14 may be formed integrally with the hull or deck of a watercraft, as shown by way of example at FIGS. 9 and 10.

Figure 7:
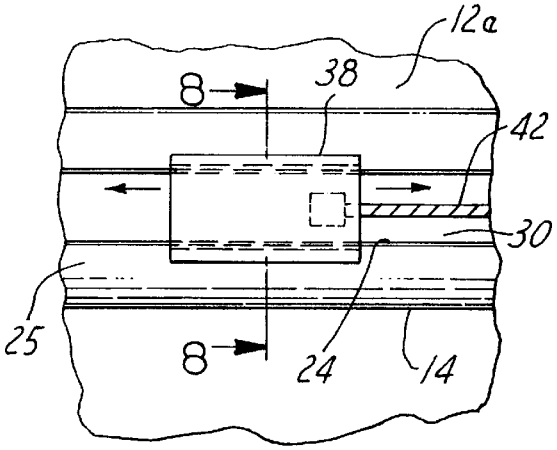
FIG. 7 is a side view seen along arrow 7 of FIG. 5.

A slide 38 is slidably mounted to the slot 24 of the sidewall 25. As shown at FIGS. 7 and 8, the slide 38 has a pair of opposed grooves 40*a*, 40*b* into which the sidewall 25 at the slot 24 is received so as to trap the slide onto the sidewall, yet allow the slide to be freely slid therealong. An external portion 38*a* of the slide 38 is graspable by a user so that the user can easily grasp the slide with his or her hand and exert a sliding force parallel to the slot 24 upon it. An internal portion 38*b* of the slide is connected with a retrieval cable 42.

Figure 6:
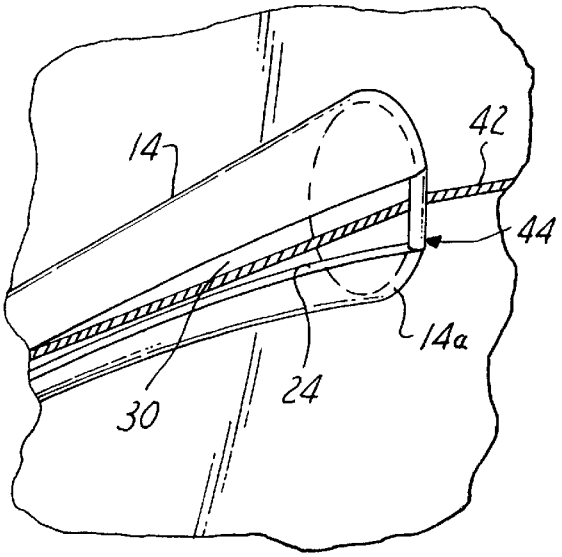
FIG. 6 is a detail perspective view seen along arrow 6 of FIG. 3.

The retrieval cable 42 is strong, but much lighter in terms of cross-sectional bulk than the mooring line 16. The length of the retrieval cable is predetermined per the length of the mooring line 16 as will become clear hereinbelow. The retrieval cable 42 emerges from the near end 14*a* of the mooring line receptacle 14 through an eyelet 44 (see FIG. 6). The retrieval cable 42 connects to a release actuator 46 which is affixed to a distal end 16*b* of the mooring line 16.

The mooring lines 16 are composed of any nautically suitable mooring line material, such as three strand nylon.

Figure 2:
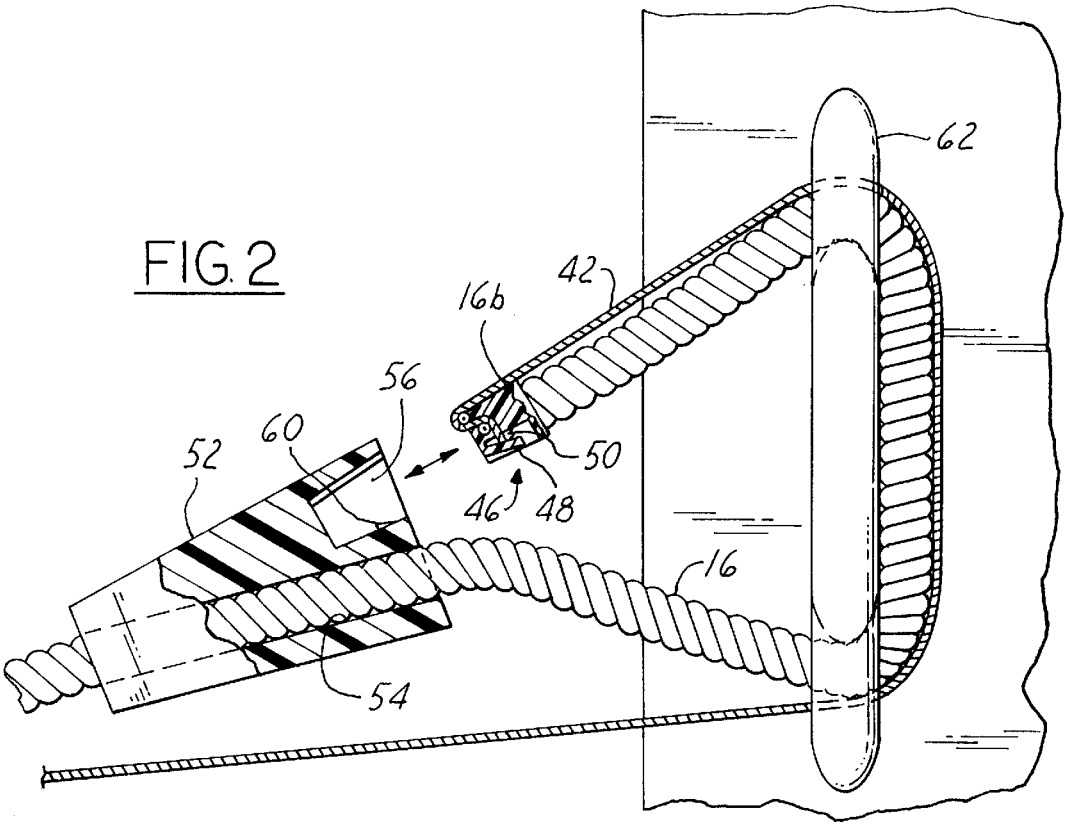
FIG. 2 is a detail, partly sectional plan view showing the connector and release actuator according to the present invention.

The mooring lines 16 each have a proximate end 16*a* which is connected to a respective cleat 26 of the watercraft, as discussed hereinabove. At the distal end 16*b* of the mooring line, the release actuator 46 is affixed (as for example by crimping) in concert with the retrieval cable 42. In this regard, as best shown at FIG. 2, the retrieval cable is operably connected to the release actuator 46. As an example thereof, the release actuator 46 is composed of a resiliently pivotable tab 48, wherein the tab is biased toward an outward position by a spring 50. Upon pulling of the retrieval cable 42, the force of the spring 50 is overcome and the tab 48 pivots to an inward position. Other release actuators may occur to those having ordinary skill in the art, and the present description is to be taken merely as a preferred example, such modifications or alternative embodiments being considered to fall within the spirit and scope of the present invention.

As best seen at FIG. 2, a connector 52 has a bore 54 through which the mooring line 16 slidably passes, wherein the cross-section of the bore is sufficiently large to allow for the sliding of the mooring line relative to the connector to be free without sticking. The connector 52 further has a socket 56 into which the release actuator 46 seats to thereby form a closed loop 58 (see FIG. 3) of the mooring line 16 between the seat and the bore of the connector. In this regard, an inclined boss 60 is resident in the socket 56 for interferingly interfacing with the tab 48 when in its normally biased outward position, but not when in its inward position. Thus, when the release actuator 46 is seated in the socket 56 the boss 60 prevents it from released therefrom. However, it is released therefrom by a user pulling upon the retrieval cable 42, because this causes the tab 48 to pivot to its inward position, whereby the release actuator is free from interference by the boss.

Figure 3:
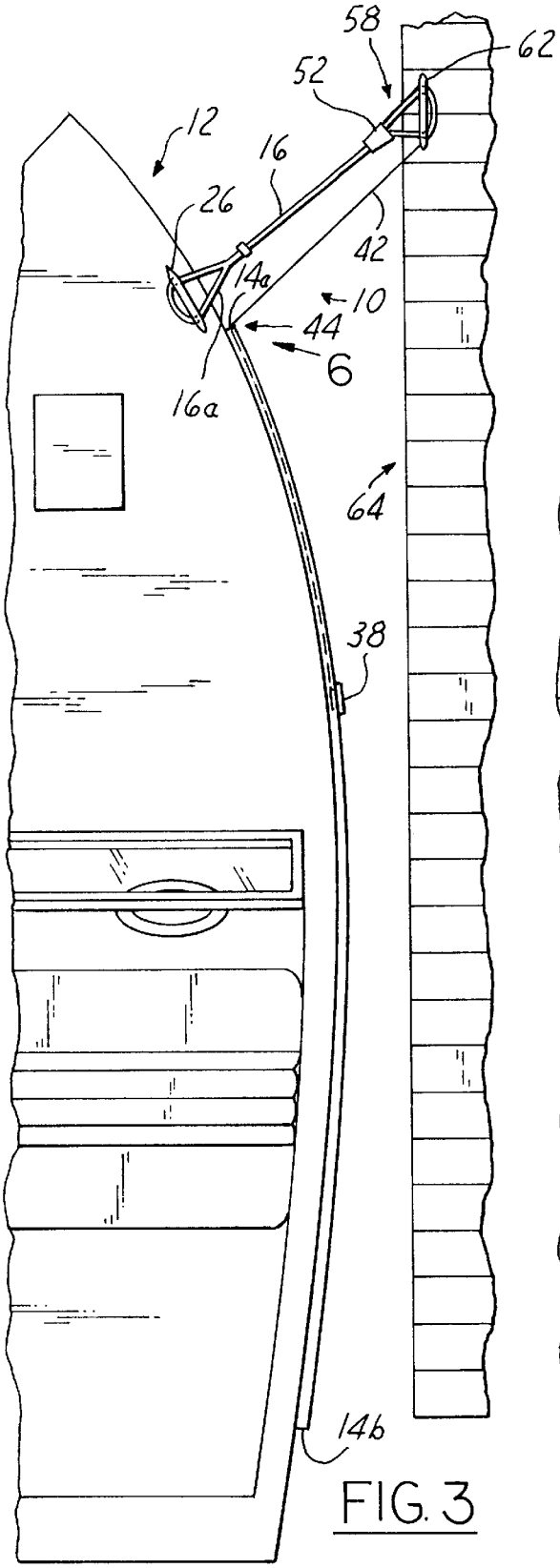
FIG. 3 is a fragmentary plan view of a watercraft equipped with the mooring line retrieval system according to the present invention, wherein the mooring line is in use to dock the watercraft.
Figure 4:
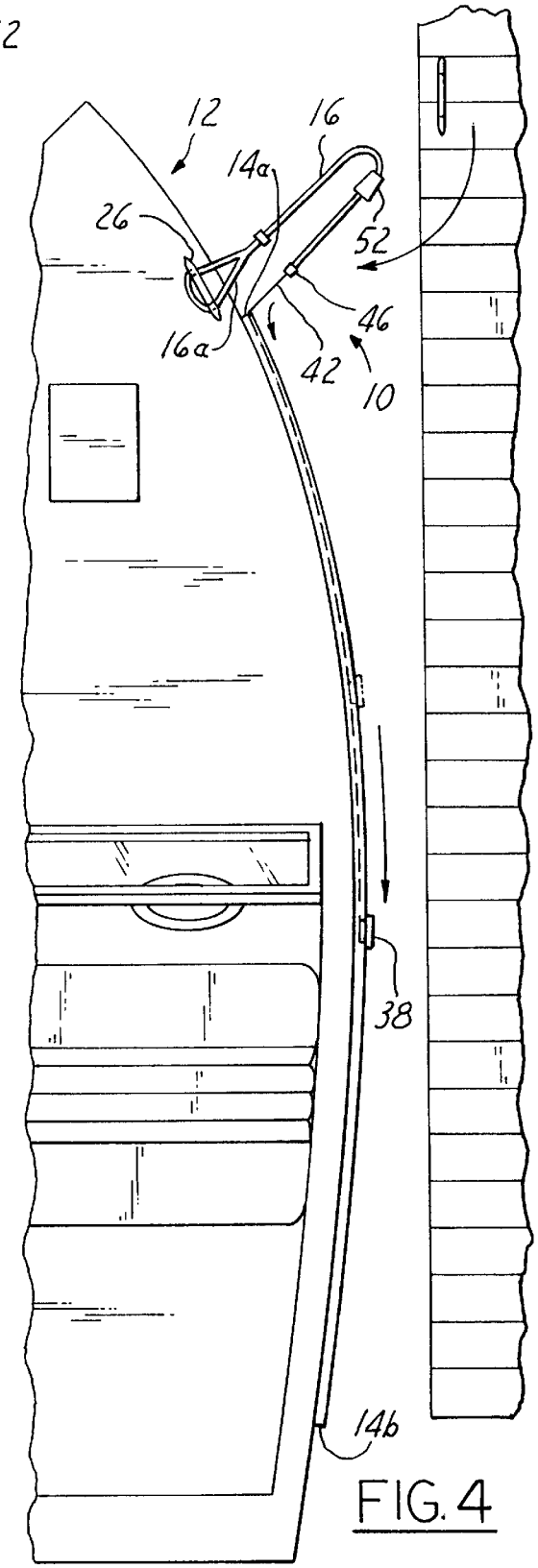
FIG. 4 is a fragmentary plan view of a watercraft equipped with the mooring line retrieval system according to the present invention, wherein the mooring line is being retrieved.
Figure 5:
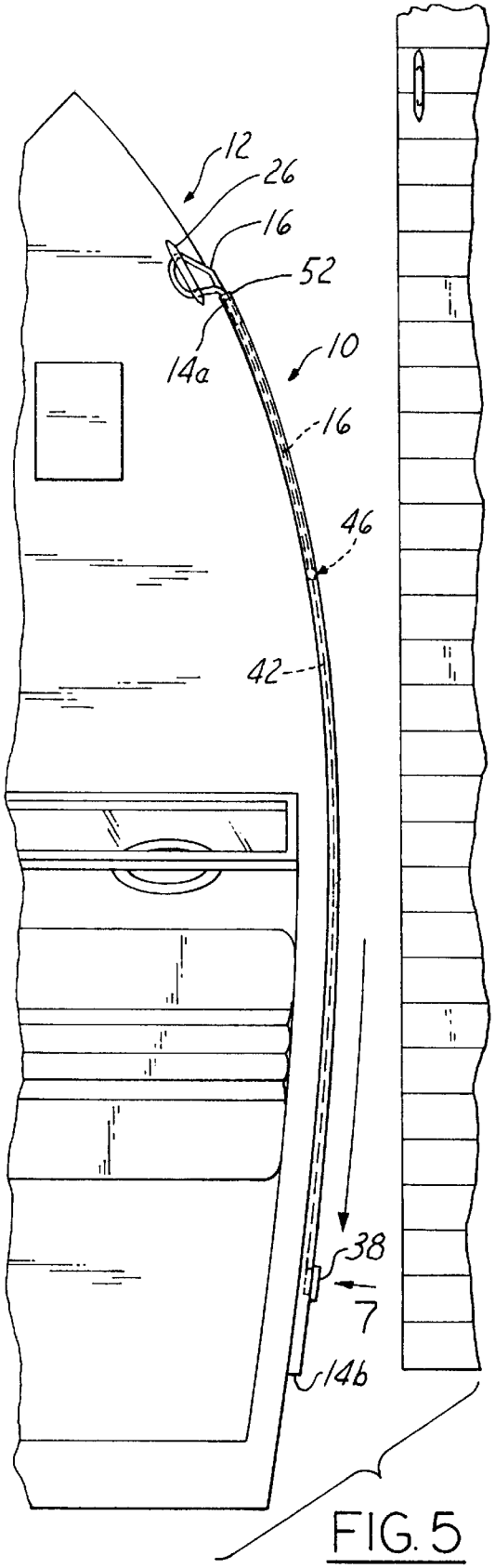
FIG. 5 is a fragmentary plan view of a watercraft equipped with the mooring line retrieval system according to the present invention, wherein the mooring line is stored.

In operation, the mooring line 16 is pulled from its mooring line receptacle 14 via the connector 52, looped around a cleat, piling, etc. 62 of a dock 64 and then the release actuator 46 is seated in the socket 56 to thereby secure the mooring line thereto as this respects the cleat 26 of the watercraft 12 (see FIGS. 1 and 3). When the skipper is ready to shove-off, the slide 38 is pulled along the mooring line receptacle in a direction away from the eyelet 44. This pulling force causes the retrieval cable to trip the release actuator 46 by retracting the tab 48 so as to allow the release actuator to separate from the socket 56. Continued pulling on the slide results in the slide moving along the mooring line receptacle so that the retrieval cable enters into the mooring line receptacle, whereupon the mooring will follow thereinto therebehind. As the mooring line enters the mooring line receptacle at the eyelet, the connector 52 remains outside as the mooring line slide through the bore 54 thereof. Now the mooring line is stored in the interior hollow 25 of the sidewall 24 of the mooring line receptacle.

It will be understood from the foregoing description and the accompanying drawings that the length of the retrieval cable is predetermined in relation to the length of the mooring line so that the slide cannot be ripped from the mooring line receptacle when the mooring line is in operation mooring the watercraft, and further that the mooring line receptacle is sufficiently elongated to accommodate (generally) the successive lengths of the retrieval a cable and the mooring line (less the external portion 16*c* thereof).

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A mooring line retrieval system for a watercraft comprising:

a mooring line having a predetermined cross-section, a proximate end and a distal end;

an elongated sidewall having a near end and an opposite far end, said sidewall forming an interior hollow having a predetermined inside diameter such that said mooring line is receivable into said interior hollow;

means for connecting said sidewall to a watercraft lengthwise between said far and near ends thereof;

retrieval means for selectively retracting said mooring line into said elongated sidewall means; and release actuator means connected with said distal end of said mooring line for selectively providing a closed loop adjacent said distal end, wherein the loop is openable responsive to said retrieval means;

wherein said retrieval means places said mooring line into said interior hollow to thereby store at least a majority of said mooring line when not being used to moor the watercraft.

2. The mooring line retrieval system of claim 1, wherein said retrieval means comprises:

eyelet means for providing an enclosed opening at said near end of said elongated sidewall; and retrieval cable means for pulling said mooring line into said interior hollow through said eyelet means, wherein said distal end thereof firstly enters therein.

3. The mooring line retrieval system of claim 2, wherein said retrieval means further comprises:

said sidewall having a slot therein which communicates with said interior hollow, said slot extending from said near end to substantially said far end, said slot having a predetermined width, wherein said slot is not occluded by the watercraft; and slide means slidably movable along said slot and connected with said retrieval cable means for providing a structure for a user to apply a pulling force onto said retrieval cable means.

4. The mooring line retrieval system of claim 2, wherein said release actuator means comprises releasable connection means for retaining said loop subject to said retrieval cable being pulled.

5. The mooring line retrieval system of claim 4, wherein said release actuator means further comprises:

a connector slidably connected with said mooring line; and a release actuator fixedly connected to said mooring line substantially adjacent said distal end thereof;

wherein said connector comprises socket means for selectively engaging said release actuator responsive to said retrieval means, wherein said release actuator is released from said socket means when said retrieval cable is pulled.

6. The mooring line retrieval system of claim 5, wherein said retrieval means further comprises:

said sidewall having a slot therein which communicates with said interior hollow, said slot extending from said near end to substantially said far end, said slot having a predetermined width, wherein said slot is not occluded by the watercraft; and slide means slidably movable along said slot and connected with said retrieval cable means for providing a structure for a user to apply a pulling force onto said retrieval cable means.

7. A watercraft having a mooring line retrieval system comprising:

a watercraft;

a mooring line having a predetermined cross-section, a proximate end and a distal end;

an elongated sidewall lengthwise connected to said watercraft, said elongated sidewall having a near end and an opposite far end, said sidewall forming an interior hollow having a predetermined inside diameter such that said mooring line is receivable into said interior hollow;

retrieval means for selectively retracting said mooring line into said elongated sidewall means; and release actuator means connected with said distal end of said mooring line for selectively providing a closed loop adjacent said distal end, wherein the loop is openable responsive to said retrieval means;

wherein said retrieval means places said mooring line into said interior hollow to thereby store at least a majority of said mooring line when not being used to moor the watercraft.

8. The watercraft of claim 7, further comprising a cleat connected to said watercraft, said near end of said mooring line being connected to said cleat.

9. The watercaft of claim 8, wherein said retrieval means comprises:

eyelet means for providing an enclosed opening at said near end of said elongated sidewall; and retrieval cable means for pulling said mooring line into said interior hollow through said eyelet means, wherein said distal end thereof firstly enters therein.

10. The watercraft of claim 9, wherein said retrieval means further comprises:

said sidewall having a slot therein which communicates with said interior hollow, said slot extending from said near end to substantially said far end, said slot having a predetermined width, wherein said slot is not occluded by the watercraft; and slide means slidably movable along said slot and connected with said retrieval cable means for providing a structure for a user to apply a pulling force onto said retrieval cable means.

11. The watercraft of claim 10, wherein said release actuator means comprises releasable connection means for retaining said loop subject to said retrieval cable being pulled.

12. The watercraft of claim 11, wherein said release actuator means further comprises:

a connector slidably connected with said mooring line; and a release actuator fixedly connected to said mooring line substantially adjacent said distal end thereof;

wherein said connector comprises socket means for selectively engaging said release actuator responsive to said retrieval means, wherein said release actuator is released from said socket means when said retrieval cable is pulled.

13. A watercraft having a mooring line retrieval system comprising:

a watercraft;

a mooring line having a predetermined cross-section, a proximate end and a distal end;

an elongated mooring line receptacle integrally formed with said watercraft, said elongated mooring line receptacle having a sidewall formed of the watercraft having a near end and an opposite far end, said sidewall forming an interior hollow having a predetermined inside diameter such that said mooring line is receivable into said interior hollow;

retrieval means for selectively retracting said mooring line into said elongated sidewall means; and release actuator means connected with said distal end of said mooring line for selectively providing a closed loop adjacent said distal end, wherein the loop is openable responsive to said retrieval means;

wherein said retrieval means places said mooring line into said interior hollow to thereby store at least a majority of said mooring line when not being used to moor the watercraft.

14. The watercraft of claim 13, further comprising a cleat connected to said watercraft, said near end of said mooring line being connected to said cleat.

15. The watercraft of claim 14, wherein said retrieval means comprises:

eyelet means for providing an enclosed opening at said near end of said elongated sidewall; and retrieval cable means for pulling said mooring line into said interior hollow through said eyelet means, wherein said distal end thereof firstly enters therein.

16. The watercraft of claim 15, wherein said retrieval means further comprises:

said sidewall having a slot therein which communicates with said interior hollow, said slot extending from said near end to substantially said far end, said slot having a predetermined width, wherein said slot is not occluded by the watercraft; and slide means slidably movable along said slot and connected with said retrieval cable means for providing a structure for a user to apply a pulling force onto said retrieval cable means.

17. The watercraft of claim 16, wherein said release actuator means comprises releasable connection means for retaining said loop subject to said retrieval cable being pulled.

18. The watercraft of claim 17, wherein said release actuator means further comprises:

a connector slidably connected with said mooring line; and a release actuator fixedly connected to said mooring line substantially adjacent said distal end thereof;

wherein said connector comprises socket means for selectively engaging said release actuator responsive to said retrieval means, wherein said release actuator is released from said socket means when said retrieval cable is pulled.

19. A method for retrieving and storing a mooring line of a watercraft, said method comprising the steps of:

providing a mooring line having a cross-section, a proximate end and an opposite distal end;

forming an elongated member having a sidewall having a near end and an opposite far end, wherein said sidewall provides an interior hollow extending between the near and far ends;

connecting the elongated member lengthwise between the near and far ends thereof to a watercraftt;

connecting the proximate end of the mooring line to the watercraft;

forming a closed loop of the mooring line adjacent the distal end thereof to thereby moor the watercraft with respect to an object;

pulling upon a cable to cause the loop to open, unmoor the watercraft and pull the mooring line into the interior hollow so that at least a majority of the mooring line is situated storingly in the interior hollow.

* * * * *